US005899837A

United States Patent [19]

Chen

[11] Patent Number: 5,899,837

[45] Date of Patent: May 4, 1999

[54] RESILIENTLY COMPRESSIBLE EXERCISE DEVICE

[75] Inventor: Shu-Mei Chen, Taipei Hsien, Taiwan

[73] Assignee: Lih Harng Industrial Co., Ltd., Taipei Hsien, Taiwan

[21] Appl. No.: 09/054,003

[22] Filed: Apr. 2, 1998

[51] Int. Cl.[6] ..... A63B 21/045; A63B 23/16

[52] U.S. Cl. ..... 482/126; 482/127; 482/49

[58] Field of Search ..... 482/44, 49, 50, 482/91, 121, 122, 126, 127, 139; 73/379.03, 379.08

[56] References Cited

U.S. PATENT DOCUMENTS

| | | | |
|---|---|---|---|
| 4,674,330 | 6/1987 | Ellis | 73/379.03 |
| 4,753,434 | 6/1988 | Salvino | 482/49 |
| 5,176,622 | 1/1993 | Anderson et al. | 482/127 |
| 5,222,926 | 6/1993 | Eggen | 482/49 |
| 5,529,551 | 6/1996 | Chin | 482/49 |
| 5,833,580 | 11/1998 | Chiu | 482/49 |

FOREIGN PATENT DOCUMENTS

| | | | |
|---|---|---|---|
| 3827394 | 3/1990 | Germany | 482/49 |

*Primary Examiner*—Richard J. Apley
*Assistant Examiner*—Victor K. Hwang
*Attorney, Agent, or Firm*—William E. Pelton

[57] ABSTRACT

An exercise device includes a resilient plate body, a pair of handles, a pair of V-clips and a flexible adjusting sheet. The plate body has a protrusion integrally and transversely formed on a middle portion thereof, and defines a pair of inclined through holes each between one of two distal edges of the plate body and the protrusion. The protrusion defines an arch therethrough which has an opening in communication with an undersurface of the plate body to receive the adjusting sheet. The pair of handles each has a metal rod encased in a sponge tube. A distal end of the metal rod extends through a respective inclined through hole of the plate body. Then the V-clip grippingly fastens the respective distal end of the metal rod. The flexible adjusting sheet is shaped to be received in the arch of the protrusion. An inner periphery of the adjusting sheet is configured to have stepped portions, such that a thickness of the adjusting sheet increases from a first end thereof to a second end thereof with the progression of the stepped portions. With this arrangement, the exercise device can provides multiple resistance options.

4 Claims, 5 Drawing Sheets

RESILIENTLY COMPRESSIBLE EXERCISE DEVICE

BACKGROUND OF THE INVENTION

1. Field of the Invention

The present invention relates to an exercise device, and more particularly to an exercise device which provides multiple resistance options by utilizing an adjusting sheet.

2. Description of Related Art

In general, exercise devices are popularly used in the modern society. Since they are movable and do not occupy a large space, the exercise device enables people to exercise indoors. A simple conventional exercise device which is designed to work out arms or hands of a user typically comprises a pair of handles and a spring mounted between the two handles. By repeatedly urging the pair of handles toward each other, the exercise effect is achieved. However, this kind of exercise device has a disadvantage that it provides only one level of resistance because the spring has a constant resilient coefficiency. A second drawback of the conventional exercise device is that it is not convenient for storage, because of it being an integral construction.

The present invention provides an improved exercise device to mitigate and/or obviate the aforementioned problems.

SUMMARY OF THE INVENTION

The main object of the present invention is to provide an exercise device which provides multiple resistance options by utilizing an adjusting sheet.

Another object of the present invention is to provide an exercise device which has a simple structure and is detachable for storage.

Other objects, advantages and novel features of the invention will become more apparent from the following detailed description when taken in conjunction with the accompanying drawings.

DETAILED DESCRIPTION OF PREFERRED EMBODIMENT

Figure 1:
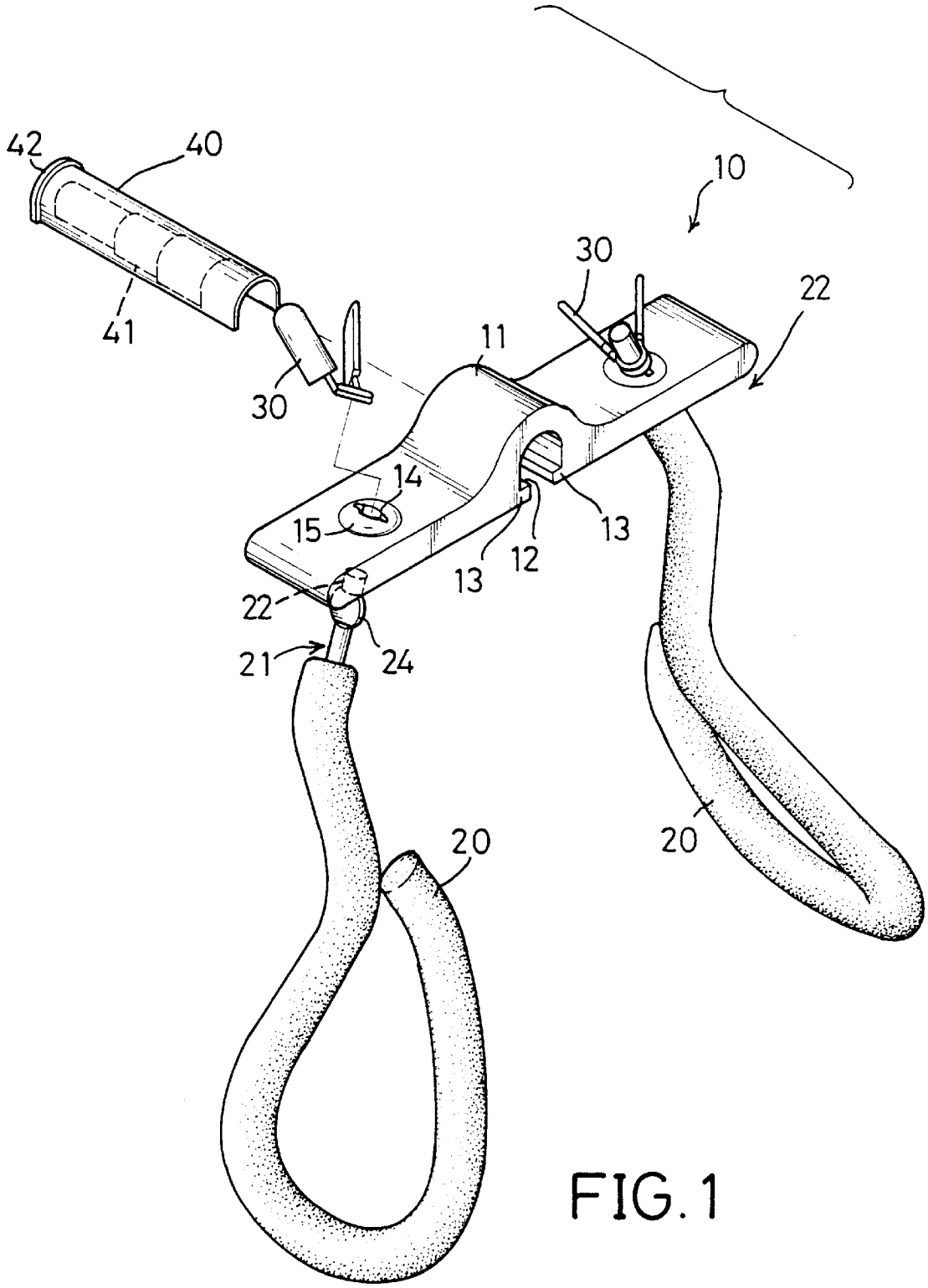
FIG. 1 is an exploded perspective view showing an exercise device in accordance with the present invention.

Referring to FIG. 1, an exercise device constructed in accordance with the present invention includes a plate body 10 made of plastic and having slight resilience. The plate body 10 has a protrusion 11 integrally and transversely formed on a middle portion thereof. The protrusion 11 defines an arch 12 therethrough which has an opening in communication with an undersurface of the plate body 10. A pair of flanges 13 extend oppositely from a bottom of the arch 12 and extend along the length thereof. The plate body 10 further defines therein a pair of inclined through holes 14 each between one of two distal edges of the plate body 10 and the protrusion 11. Additionally, two reinforcement projections 15 are respectively and integrally formed on the plate body 10 around a top end and a bottom end of each inclined through hole 14.

Figure 2:
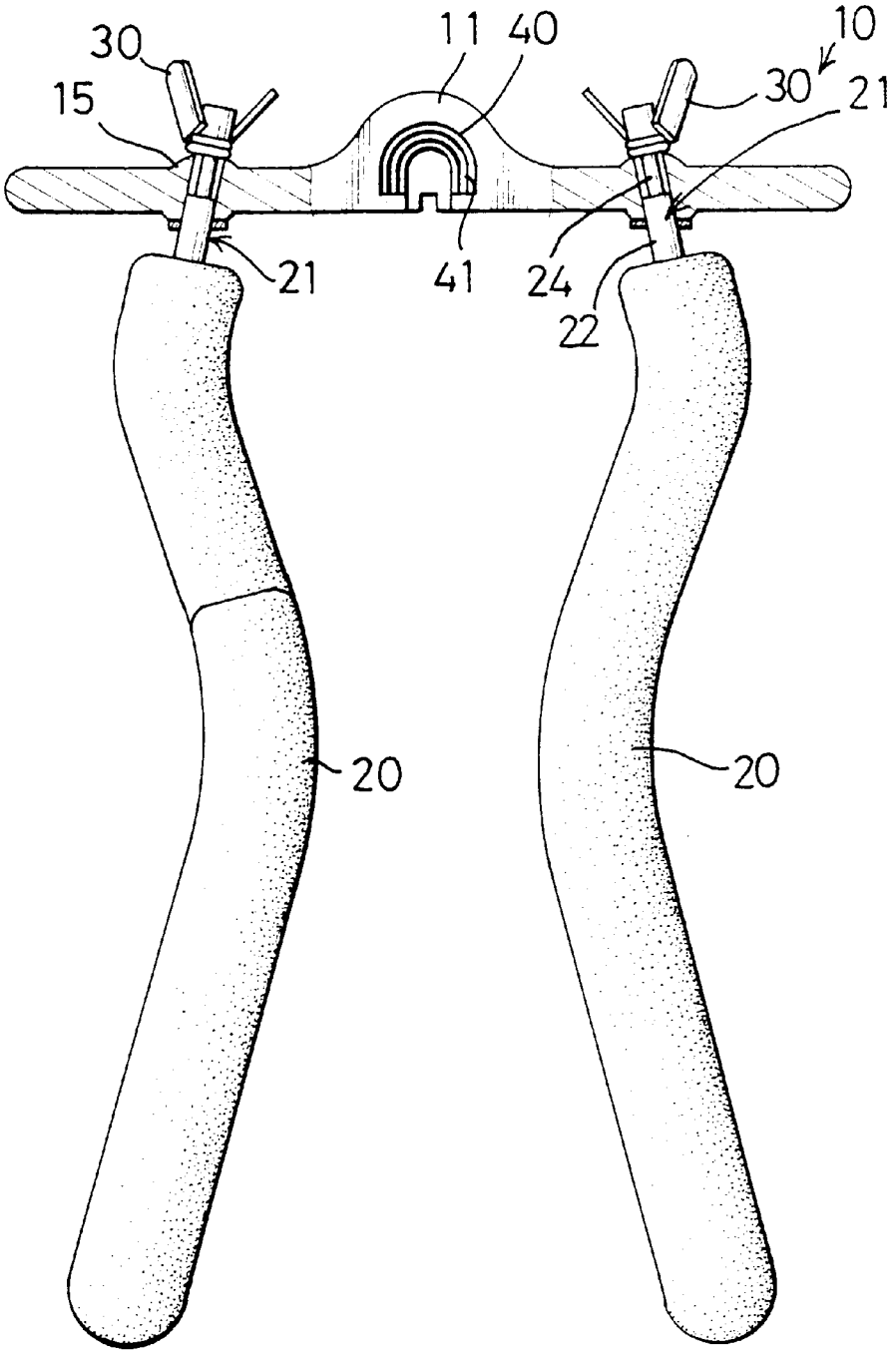
FIG. 2 is a partial cross sectional view showing a combined structure of the exercise device of the present invention.
Figure 3:
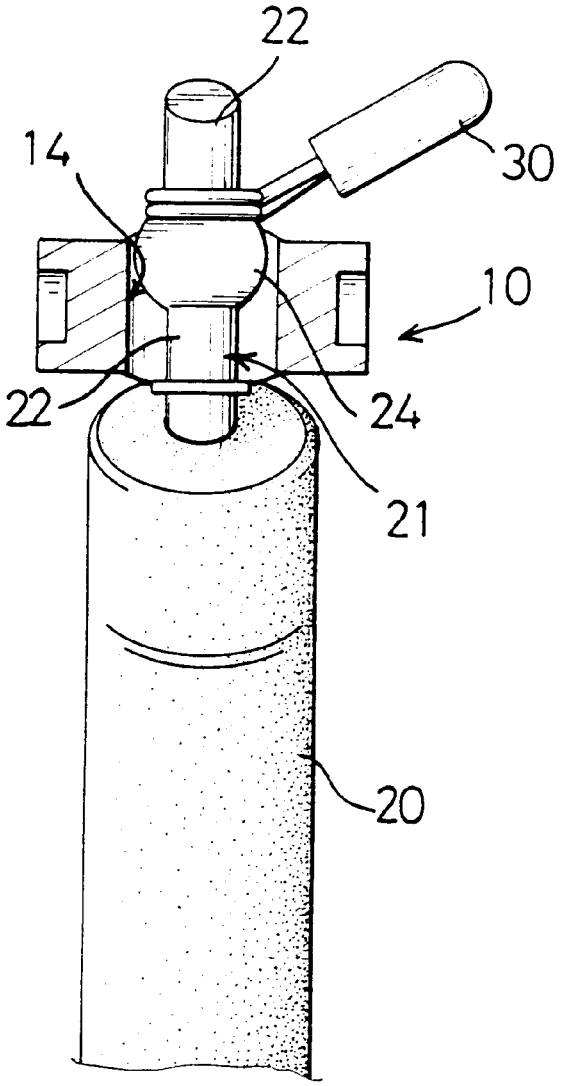
FIG. 3 is a perspective view in partial cross section showing the engagement of a metal rod and a clip of the exercise device in accordance with the present invention.
Figure 4:
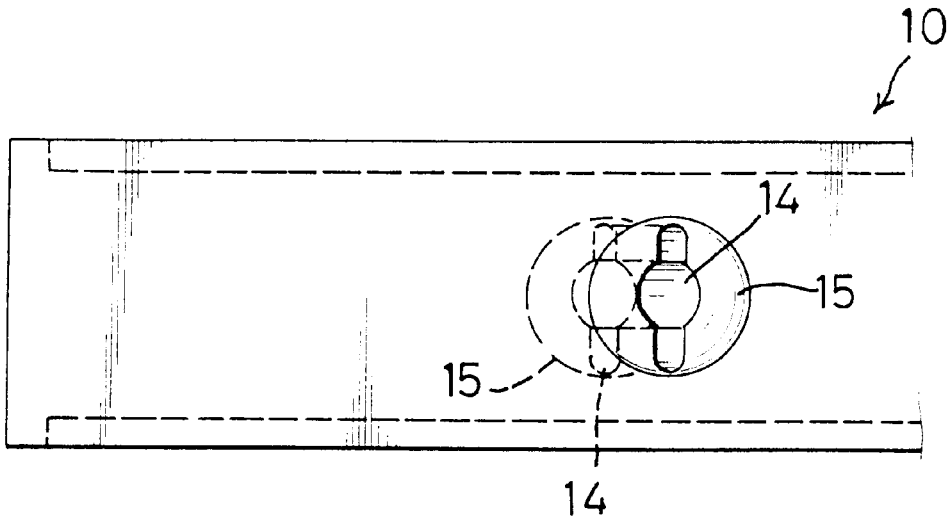
FIG. 4 is a top view showing a hole defined in a plate body of the exercise device in accordance with the present invention.

The exercise device further includes a pair of handles 20 engaged with the plate body 10 and shaped to facilitate holding by a user. As the handles 20 are identical, a description of only one is supplied hereinafter. The handle 20 comprises a metal rod 21 encased in a sponge tube. The metal rod 21 has a distal end 22 projecting from the sponge tube. The distal end 22 has a disk-like extension 24, and a bar section (not numbered) formed between the sponge tube and the disk-like extension 24. The disk-like extension 24 and the bar section can be extended through a respective inclined through hole 14 of the plate body 10 and then a V-clip 30 can be applied onto the bar section of the distal end 22 to grippingly fasten the metal rod 21, thereby mounting the handle 20 to the plate body 10, as shown in FIG. 2 and FIG. 3. It is appreciated that, with the reinforcement projections 15 of the plate body 10, the V-clip 30 can be securely engaged with distal end 22 of the metal rods 21.

The exercise device further includes an adjusting sheet 40 shaped to be received in the arch 12 of the protrusion 11 of the plate body 10. The adjusting sheet 40 has a lip 42 integrally formed at an end thereof to prevent separation from the arch 12 after it is movably received within the protrusion 11. The adjusting sheet 40 is sized to abut upper faces of the opposed flanges 13 such that it is securely retained in the plate body 10. An inner periphery of the adjusting sheet 40 is configured to have stepped portions 41, therefore a thickness of the adjusting sheet 40 increases from a first end thereof to a second end thereof with the progression of the stepped portions.

Figure 5:
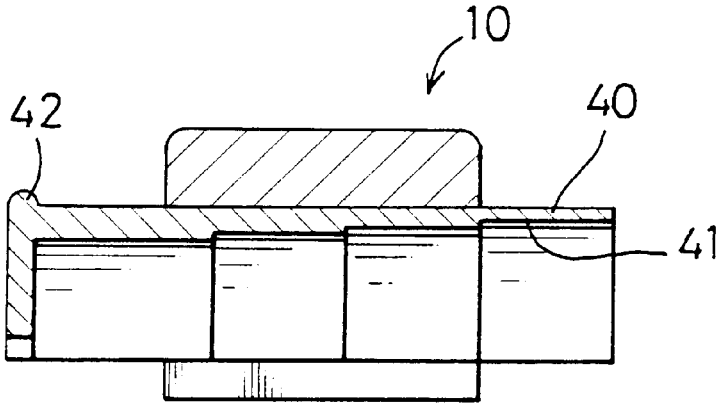
FIG. 5 is a schematic plane view in partial cross section showing engagement of an adjustment sheet and the plate body of the exercise device in accordance with the present invention.
Figure 6:
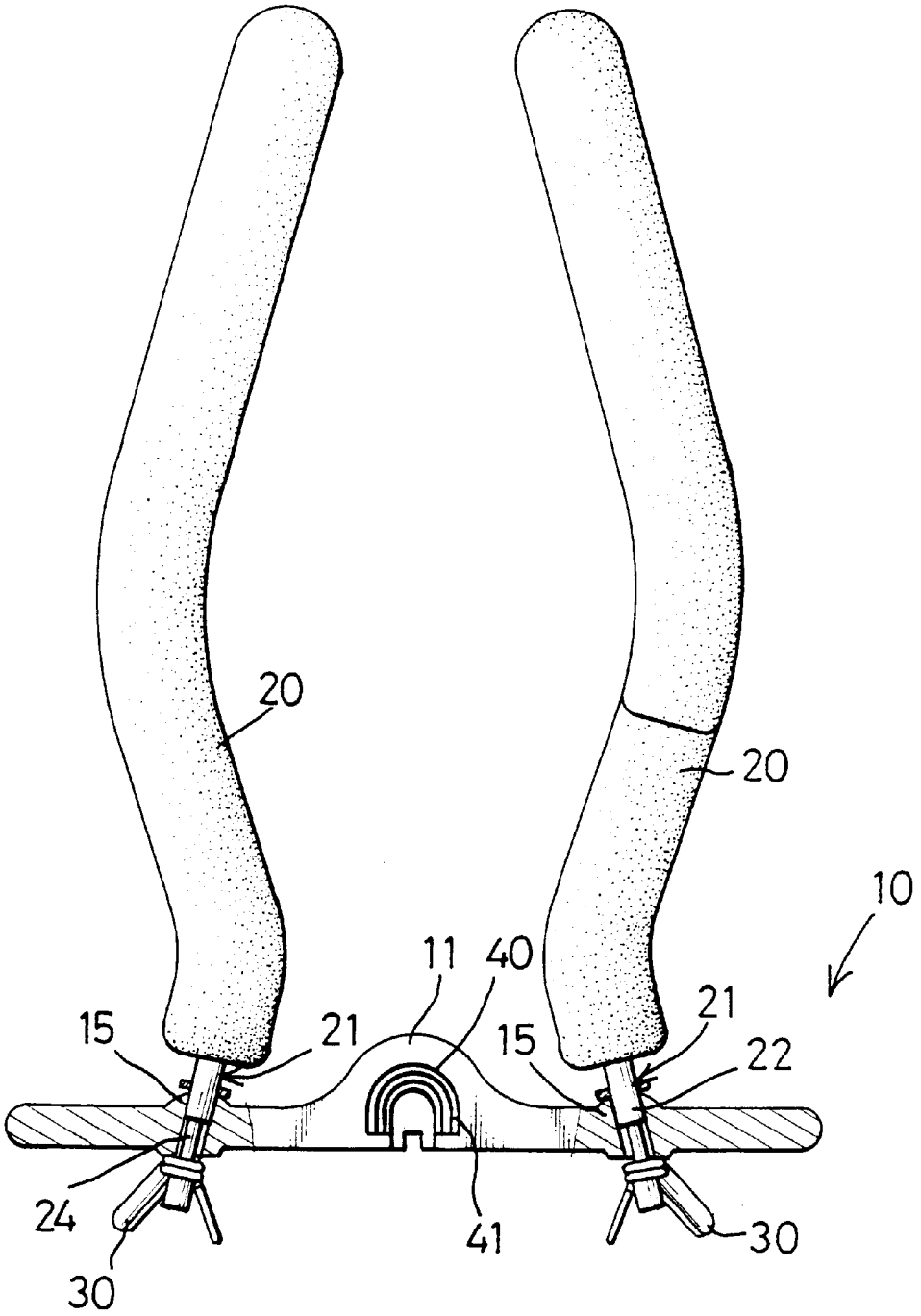
FIG. 6 is a perspective view in partial cross sectional showing an alternative embodiment of the exercise device in accordance with the present invention.

In a preferred embodiment, the portions of the handles 20 encased in the sponge tube are mounted below the plate body 10. In operation, urging the pair of handles 20 toward each other will transfer a force onto the protrusion 11 of the plate body 10. Since the protrusion 11 of the plate body 10 is resilient, a user may exercize his arms or hands by repeatedly urging the handles 20. After the adjusting sheet 40 is applied in the arch 12 of the protrusion 11, the force required to urge the handles 20 is increased, because the adjusting sheet 40 will generate a reacting force to apply to the protrusion 11 during the urging. As shown in FIG. 5, any stepped portion of the adjusting sheet can be selected and located in the arch 12 to adjust the resistance level of the exercise device according to requirements of the user. Referring to FIG. 6, in an alternative preferred embodiment of the present invention, the pair of handles 20 may be mounted above the plate body 10. It is to be understood that the same effect as the above mentioned embodiment can be obtained by urging the pair of handles 20 away from each other.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An exercise device comprising:

a resilient plate body having a protrusion integrally and transversely formed on a middle portion thereof, and defining therein a pair of inclined through holes each between one of two distal edges of the plate body and the protrusion, said protrusion defining an arch therethrough which has an opening in communication with an undersurface of the plate body, said arch having pair of flanges extending oppositely from a bottom of the arch and extending along the length thereof;

a pair of handles each having a metal rod, a distal end of the metal rod extending through a respective through hole of the plate body;

a V-clip grippingly fasten the distal end of the metal rod; and a flexible adjusting sheet shaped to be received in the recess of the protrusion, an inner periphery of the adjusting sheet being configured to have stepped portions, such that a thickness of the adjusting sheet increases from a first end thereof to a second end thereof with the progression of the stepped portions.

2. An exercise device as claimed in claim 1, wherein said distal end of the metal rod of each handle has a disk-like extension, and a bar section formed with the disk-like extension, and said V-clip is applied onto the bar section after the disk-like extension and the bar section extend through the respective inclined through hole of the plate body, thereby mounting the handle to the plate body.

3. An exercise device as claimed in claim 1, wherein said plate body further has two reinforcement projections respectively and integrally formed thereon and around a top end and a bottom end of each inclined through hole.

4. An exercise device as claimed in claim 1, wherein said flexible adjusting sheet has a lip integrally formed at one end thereof to prevent separation from the arch of the protrusion.

* * * * *